US012474138B2

(12) United States Patent
Chen et al.

(10) Patent No.: US 12,474,138 B2
(45) **Date of Patent: *Nov. 18, 2025**

(54) SPRING-LOADED PIERCING MECHANISM FOR A PRESSURIZED GAS VESSEL

(71) Applicant: BANZA STAMPING INDUSTRY CORP, Su'ao Township (TW)

(72) Inventors: Li-Wei Chen, Su'ao Township (TW); Chun-Yi Wang, Su'ao Township (TW); Shen-Kai Ho, Su'ao Township (TW)

(73) Assignee: BANZA STAMPING INDUSTRY CORPORATION, Su'ao Township (TW)

( * ) Notice: Subject to any disclaimer, the term of this patent is extended or adjusted under 35 U.S.C. 154(b) by 0 days.

This patent is subject to a terminal disclaimer.

(21) Appl. No.: 19/264,558

(22) Filed: Jul. 9, 2025

(65) Prior Publication Data

US 2025/0341380 A1 Nov. 6, 2025

Related U.S. Application Data

(63) Continuation-in-part of application No. 18/666,354, filed on May 16, 2024, which is a continuation-in-part of application No. 29/896,694, filed on Jul. 6, 2023.

(30) Foreign Application Priority Data

Jun. 19, 2023 (TW) ..... 112303076

(51) Int. Cl.
*F41B 11/62* (2013.01)
*F41B 11/73* (2013.01)

(52) U.S. Cl.
CPC ..... *F41B 11/62* (2013.01); *F41B 11/73* (2013.01)

(58) Field of Classification Search
CPC ..... F41B 11/62; F41B 11/723; F41B 11/57; F41B 11/721; F41B 11/64; F41B 11/71;
(Continued)

(56) References Cited

U.S. PATENT DOCUMENTS 127,873 A * 6/1872 Hannah ..... F41A 21/08 124/58
749,519 A * 1/1904 Benjamin ..... F41B 11/72 124/73

(Continued)

*Primary Examiner* — Michael D David
(74) *Attorney, Agent, or Firm* — Eric B. Fugett; Mark A. Pitchford; Pitchford Fugett, PLLC

(57) ABSTRACT

A piercing mechanism for a pressure vessel having a recessed membrane includes an inner housing that receives the pressure vessel and controls longitudinal movement of the vessel. The inner housing is slidably received in an outer housing, which can constrain the inner housing to reciprocating longitudinal movement therein. A pin in the outer housing configured to selectably pierce the membrane extends longitudinally through the inner housing in alignment with the membrane when the pressure vessel is received in the inner housing. A biasing member in the outer housing biases the inner housing away from an interior surface of the outer housing so the pin does not contact the membrane when the pressure vessel is received in the inner housing. The inner housing is selectably slidable to compress the biasing member and cause the pin to pierce the membrane when the pressure vessel is received in the inner housing.

20 Claims, 10 Drawing Sheets

(58) Field of Classification Search
CPC ..... F41B 11/724; F41B 11/54; F41B 11/73; F41B 11/00
USPC ..... 124/73, 70, 67, 76, 69, 77, 37, 58, 71
See application file for complete search history.

(56) References Cited

U.S. PATENT DOCUMENTS 1,191,877 A * 7/1916 Dickey ..... F41B 11/72 124/76
1,366,577 A * 1/1921 Mahern ..... F41B 7/00 124/56
2,605,756 A * 8/1952 Bertschinger ..... F41B 11/647 124/58
4,865,009 A * 9/1989 Ford ..... F41B 11/723 124/76
4,986,251 A * 1/1991 Lilley ..... F41B 11/54 124/52
5,186,156 A * 2/1993 Clayton ..... F41B 11/54 124/66
5,193,517 A * 3/1993 Taylor ..... F41B 11/64 124/67
5,727,538 A * 3/1998 Ellis ..... F41B 11/52 124/32
6,053,157 A * 4/2000 Frank ..... F41B 11/00 114/238
6,089,139 A * 7/2000 Russell ..... F41B 11/00 89/14.05
6,543,365 B1 * 4/2003 Vasel ..... F41B 11/62 102/370
6,581,585 B2 * 6/2003 Nibecker, Jr. ..... F41B 11/723 124/76
6,708,685 B2 * 3/2004 Masse ..... F41B 11/724 124/75
6,874,492 B1 * 4/2005 Schavone ..... F41B 11/721 124/31
6,901,689 B1 * 6/2005 Bergstrom ..... F41A 3/92 42/1.06
7,086,393 B1 * 8/2006 Moss ..... F41B 11/723 124/70
7,287,527 B1 * 10/2007 Piper ..... F41B 11/50 124/75
8,322,329 B1 * 12/2012 Sikes ..... F41B 11/723 124/73
9,664,475 B1 * 5/2017 Maggiore ..... F41B 11/54
10,451,379 B2 * 10/2019 Heckert ..... F41A 19/16
2002/0100361 A1 * 8/2002 Russell ..... F41B 11/00 89/14.5
2002/0178901 A1 * 12/2002 Bergstrom ..... F41A 25/20 89/198
2003/0047105 A1 * 3/2003 Vasel ..... F41B 11/57 102/502
2003/0056778 A1 * 3/2003 Schavone ..... F41B 11/721 124/74
2005/0188886 A1 * 9/2005 Vasel ..... F41B 11/57 102/502
2007/0017497 A1 * 1/2007 Masse ..... F41B 11/73 124/73
2007/0175324 A1 * 8/2007 Adams ..... F41B 11/721 89/7
2008/0078369 A1 * 4/2008 Yeung ..... F41B 11/64 124/67
2009/0241931 A1 * 10/2009 Masse ..... F41B 11/71 124/76
2010/0286791 A1 * 11/2010 Goldsmith ..... A61B 17/12022 604/524
2011/0017188 A1 * 1/2011 Call ..... F41B 11/723 124/73
2011/0088676 A1 * 4/2011 Maruyama ..... F41B 11/721 124/82
2013/0214526 A1 * 8/2013 Annuzzi, Jr. ..... F41B 11/62 285/93
2016/0153741 A1 * 6/2016 Axelsson ..... F41B 11/723 124/73
2017/0336169 A1 * 11/2017 Axelsson ..... F41B 11/62
2018/0274728 A1 * 9/2018 Dos Passos ..... F41B 11/62
2019/0023414 A1 * 1/2019 Palmer ..... B64G 1/002
2019/0374718 A1 * 12/2019 Chen ..... A61M 5/2053
2020/0132412 A1 * 4/2020 Pedicini ..... F41B 11/64
2021/0108879 A1 * 4/2021 Clemons ..... F41B 11/643
2021/0113767 A1 * 4/2021 Chen ..... A61M 5/31513
2021/0356976 A1 * 11/2021 Chen ..... G05D 16/109
2022/0099404 A1 * 3/2022 Sullivan ..... F41B 11/721
2022/0170720 A1 * 6/2022 Clemons ..... F41H 9/10
2022/0276020 A1 * 9/2022 Sullivan ..... F41B 11/721
2023/0184507 A1 * 6/2023 Ash ..... F41B 11/62 124/56
2024/0085145 A1 * 3/2024 Porat ..... F41C 23/04
2024/0302129 A1 * 9/2024 Du Plessis ..... F41B 11/723
2024/0418475 A1 * 12/2024 Chen ..... F41B 11/62
2024/0418476 A1 * 12/2024 Chen ..... F41B 11/73

* cited by examiner

SPRING-LOADED PIERCING MECHANISM FOR A PRESSURIZED GAS VESSEL

CROSS-REFERENCE TO RELATED APPLICATIONS

This application is a continuation-in-part of U.S. patent application Ser. No. 18/666,354 entitled "PRESSURIZED GAS VESSEL AND PIERCING MECHANISM" and filed on May 16, 2024, which is a continuation-in-part application of U.S. Design patent application Ser. No. 29/896,694 entitled "GAS CYLINDER" and filed Jul. 6, 2023, which claims priority to Taiwanese Design patent application Ser. No. 11/230,3076 filed Jun. 19, 2023, all of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to pressurized gas vessels. More particularly, this invention pertains to high pressure gas vessels and tapping systems and methods for high pressure gas vessels.

Mass produced, single use compressed carbon dioxide (CO2) gas cylinders are used in a number of applications including airguns, model airplanes, model cars, and portable soda machines. Although referred to as pressurized gas cylinders, these pressure vessels typically contain a mixture of liquid and gaseous CO2 in equilibrium at operating pressures of about 800-900 psi for a 12 g CO2 cartridge depending on the temperature. These pressure vessels are typically made up of a cylinder that necks down at one end and includes threads around the neck. The cylinder is filled and closed with a cap having a relatively thin membrane at the outer surface of the cap (i.e., even with the opening of the cylinder neck). When the cylinder is screwed into a device (i.e., airgun, model plane, model car, portable soda machine, etc.), an o-ring seals about the neck of the cylinder and a pin fixed in place inside the device pierces the membrane of the cap, allowing the pressurized gas into the device for use by the device. These single use cylinders pressurized CO2 cartridges come in a variety of standardized sizes.

There is a desire for higher pressure cartridges such that devices operated by compressed air can be more powerful or deliver more regulated energy over time with each cartridge. Nitrogen (N2) liquid/gas pressure vessels operate at about 3600 psi in common ambient temperatures (i.e., about 21 C). Thus, devices operating on nitrogen gas can be 3-4 times more powerful than CO2 operated devices, or devices can run 3-4 times longer on a cylinder of a given size. However, because the pressures of N2 cartridges are so much higher than CO2 cartridges, N2 cartridges inserted into a device designed for CO2 cartridges can result in catastrophic failure, potentially causing injuries to users. Additionally, it can be impossible to fully seat (e.g., screw in) an N2 cartridge in a prior art CO2 cartridge style housing because of back pressure when the pin in the device partially pierces the N2 cartridge membrane. At 3-4 times the back pressure, once pierced, a user may not be able to screw the cartridge into the housing further to get the pin fully through the membrane such that gas flow from the cartridge to the device may be insufficient in such a partial piercing scenario. Thus, piercing N2 cartridges with prior art housings and pins is both unreliable and dangerous.

SUMMARY OF THE INVENTION

Aspects of the present invention are directed to compressed gas pressure vessels and devices utilizing such vessels. More particularly, aspects of the present invention are directed to high pressure (i.e., N2 based) pressurized gas cylinders with pierceable membranes recessed from the opening of the pressure vessel such that prior art piercing mechanisms cannot pierce the membrane for safety purposes. Additionally, aspects of the present invention are directed to pressurized gas operated devices with elongated pins for piercing pressure vessels with recessed pierceable membranes.

In one aspect, a pressure vessel includes a hollow body and a cap. The hollow body has an opening. The cap includes a shoulder, a sidewall, and a membrane. The shoulder has a bottom surface configured to abut the hollow body about the opening in the hollow body when the pressure vessel is assembled. The shoulder is generally planar having a hole therethrough. The sidewall extends longitudinally and perpendicularly from the bottom surface of the shoulder about the hole. The sidewall has a central opening. The membrane closes off the central opening. The membrane is longitudinally offset from the shoulder (e.g., at an opposite end of the sidewall from the shoulder).

In another aspect, a piercing mechanism for a pressure vessel includes a pin, a housing, and a pressure vessel seal. The pin is configured to pierce the membrane of the pressure vessel. The membrane is recessed from the surface of the pressure vessel within a generally cylindrical central opening of the pressure vessel. The pin includes an upper portion at a top of the pin, a lower portion at a bottom of the pan, and a longitudinal passage extending longitudinally through the pin. The housing is configured to receive the pin and a neck of the pressure vessel, line the pin with the central opening of the pressure vessel, and control longitudinal movement of the pressure vessel. The pressure vessel seal is configured to seal between the neck of the pressure vessel and the housing when the neck of the pressure vessel is received in the housing. The lower portion of the pin has a width smaller than the width of the membrane of the pressure vessel and extends longitudinally further than the membrane is recessed from the surface of the pressure vessel.

In another aspect, an airgun including a piercing mechanism for a pressure vessel. The piercing mechanism for a pressure vessel includes a pin, a housing, and a pressure vessel seal. The pin is configured to pierce the membrane of the pressure vessel. The membrane is recessed from the surface of the pressure vessel within a generally cylindrical central opening of the pressure vessel. The pin includes an upper portion at a top of the pin, a lower portion at a bottom of the pan, and a longitudinal passage extending longitudinally through the pin. The housing is configured to receive the pin and a neck of the pressure vessel, line the pin with the central opening of the pressure vessel, and control longitudinal movement of the pressure vessel. The pressure vessel seal is configured to seal between the neck of the pressure vessel and the housing when the neck of the pressure vessel is received in the housing. The lower portion of the pin has a width smaller than the width of the membrane of the pressure vessel and extends longitudinally further than the membrane is recessed from the surface of the pressure vessel.

In yet another aspect, a piercing mechanism for a pressure vessel includes an inner housing, an outer housing in which the inner housing is slidably received, a pin in the outer housing extending longitudinally through a portion of the inner housing, and a biasing member in the outer housing. The inner housing is configured to receive the pressure vessel and control longitudinal movement of the pressure vessel in the inner housing. The outer housing is configured to constrain the inner housing to reciprocating longitudinal movement in the outer housing. The pin is aligned with the membrane and configured to selectably pierce the membrane when the pressure vessel is received in the inner housing. The biasing member is configured to bias the inner housing longitudinally away from an interior surface of the outer housing so that the pin does not contact the membrane when the pressure vessel is received in the inner housing. The inner housing is selectably slidable toward the interior surface of the outer housing to compress the biasing member and cause the pin to pierce the membrane upon the application of a force to an end of the pressure vessel opposite the membrane when the pressure vessel is received in the inner housing.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
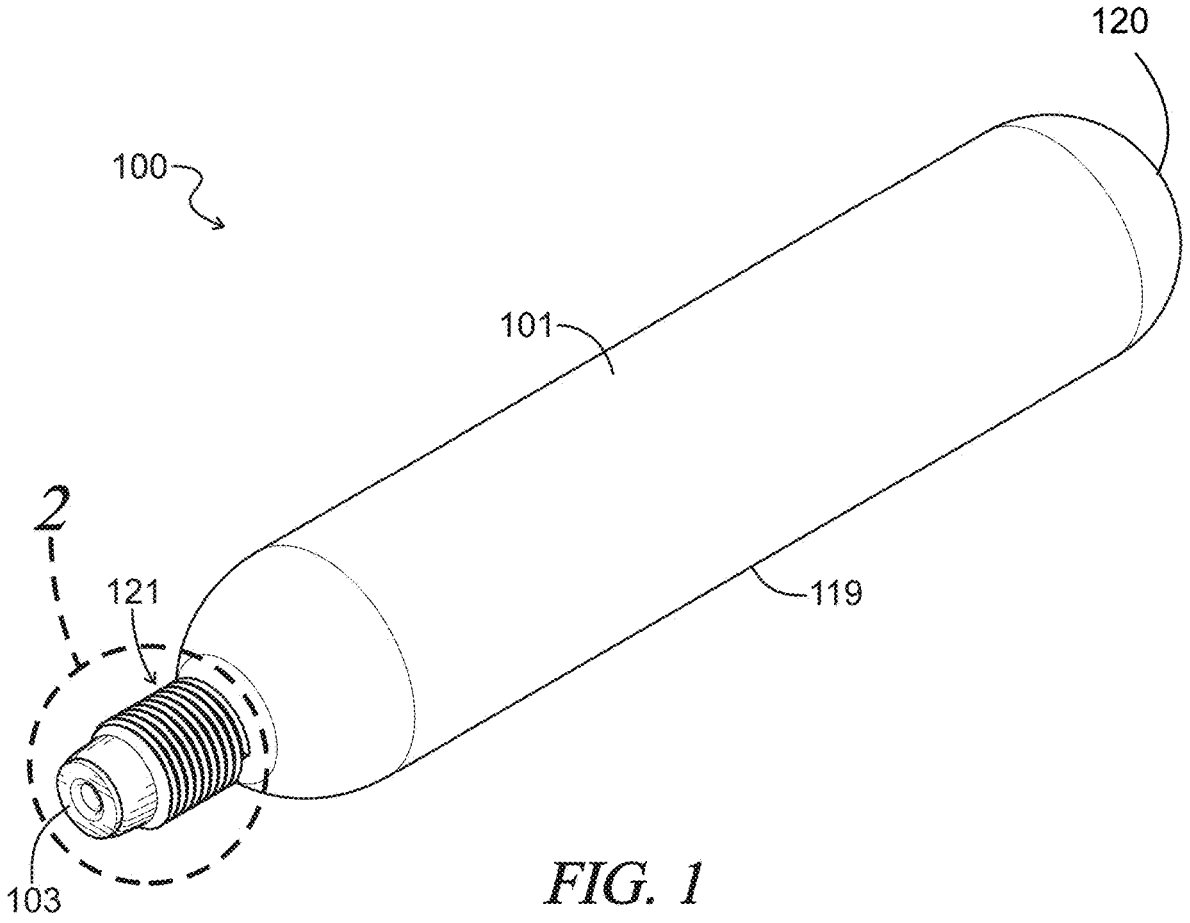
FIG. 1 is an isometric view of a pressure vessel according to one embodiment of the invention.
Figure 2:
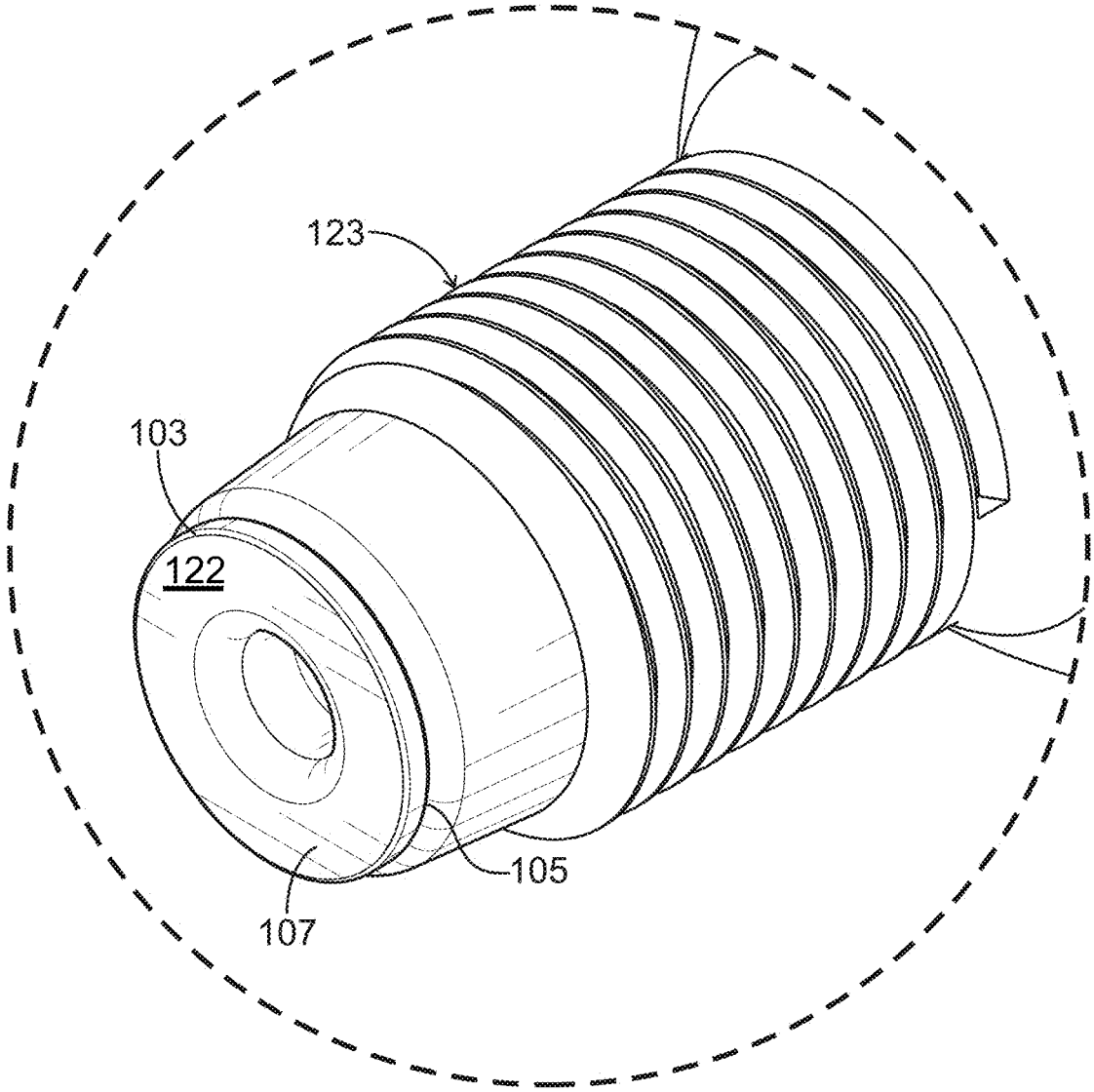
FIG. 2 is an enlarged isometric view of the highlighted segment of the pressure vessel of FIG. 1.
Figure 3:
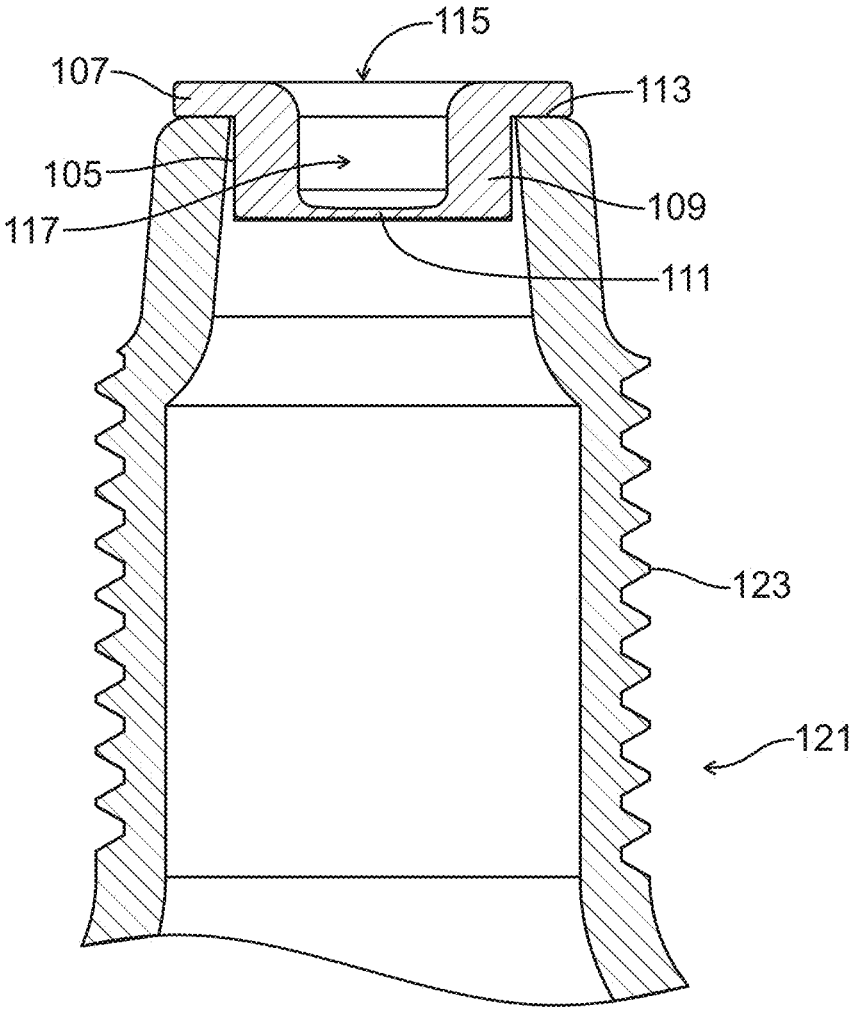
FIG. 3 is a side cutaway view of the neck of the pressure vessel of FIG. 1.
Figure 4:
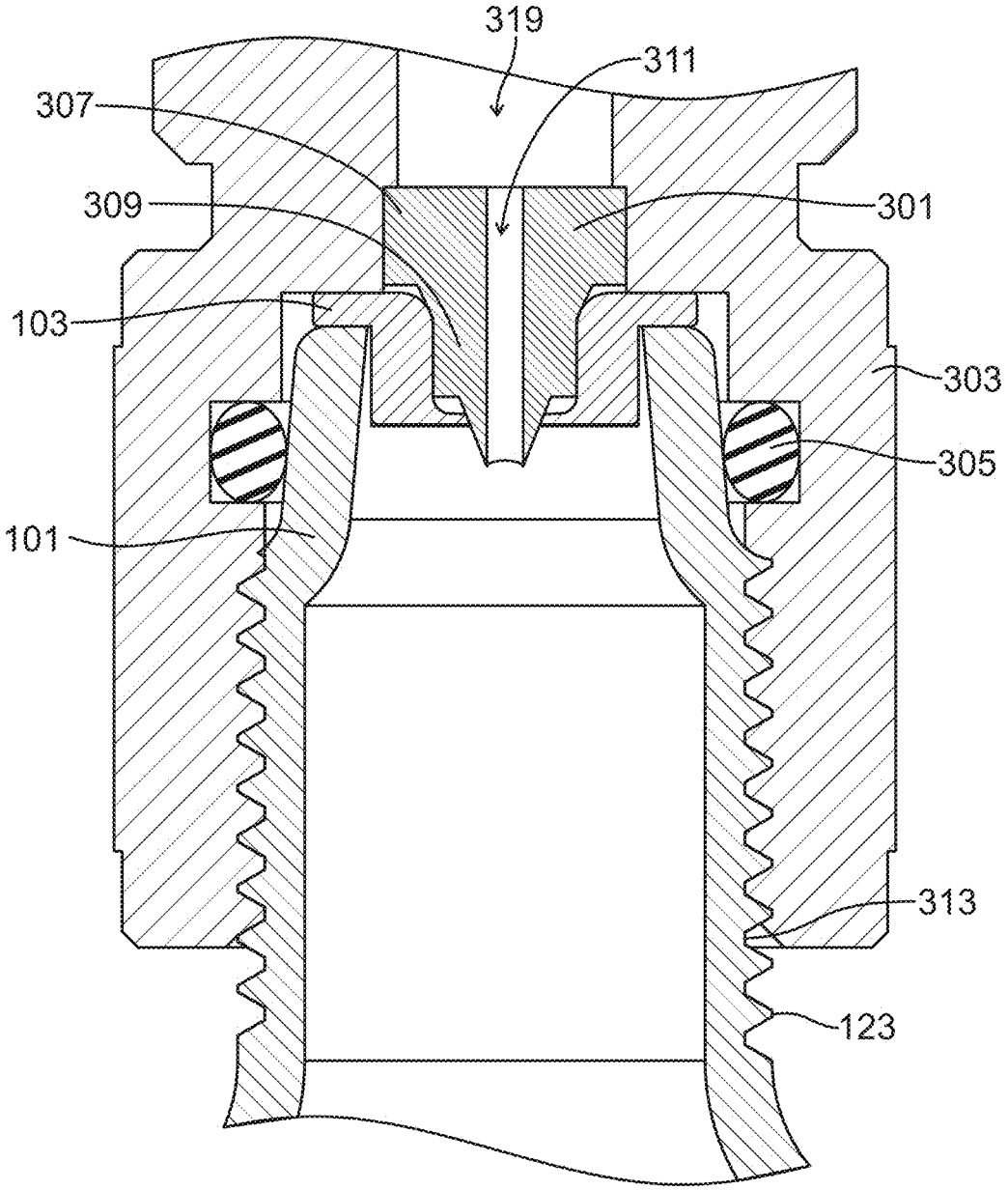
FIG. 4 is a side cutaway view of the pressure vessel of FIG. 1 inserted into a piercing mechanism according to another embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright or vertical position of a gun or firearm is when assembled and with the opening of the pressure vessel at a top of the pressure vessel such that the neck and piercing mechanism extend generally vertically along a longitudinal axis. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-7, a pressure vessel 100 includes a hollow body 101, and a cap 103. The hollow body 101 has an opening 105. In one embodiment, the pressure vessel 100 is formed of metal such as steel.

The cap 103 includes a shoulder 107, a sidewall 109, a membrane 111, and an upper surface 122. The membrane 111 is recessed from (i.e., below) the upper surface 122. The shoulder 107 has a bottom surface 113 configured to abut the hollow body 101 about the opening 105 in the hollow body 101 when the pressure vessel 100 is assembled. The shoulder 107 is generally planar having a hole 115 therethrough. The sidewall 109 extends longitudinally and perpendicularly from the bottom surface 113 of the shoulder 107 about the hole 115. The sidewall 109 has a central opening 117. The membrane 111 closes off the central opening 117, and the membrane 111 is longitudinally offset from the shoulder 107. In one embodiment, the shoulder 107 and membrane 111 are at opposing ends of the sidewall 109. In one embodiment, the shoulder 107 and sidewall 109 are generally annular and the membrane 111 is disc shaped. In one embodiment, the pressure vessel 100 contains a mixture of liquid and gaseous nitrogen (i.e., N2) when assembled and the cap 103 is welded to the hollow body 101. In one embodiment, the hollow body 101 is generally cylindrical with a rounded bottom end and a necked down top end. In one embodiment, the hole 115 through the shoulder 107 is generally circular, the central opening 117 is generally circular, the shoulder 107 is generally circular, and the membrane 111 is generally circular and planar.

In one embodiment, the hollow body 101 includes a generally cylindrical main body 119 extending longitudinally. The hollow body 101 also includes a neck 121 extending from the main body 119, and the neck 121 has threads 123 thereon. The neck 121 has a small diameter than the main body 119. The neck 121 is at a top of the main body 119, and the bottom of the main body 119 is generally rounded. The neck 121 and threads 123 are integral with the main body 119.

When the pressure vessel 100 is assembled (i.e., containing pressurized gas over liquid such as N2), the sidewall 109 extends into the opening 105, and the bottom surface 113 of the shoulder 107 is affixed (e.g., welded) to the top of the opening 105 in the neck 121 of the pressure vessel 100. The membrane 111 is thus recessed into the opening 105 and neck 121 of the pressure vessel 100 such that the membrane 111 is protected and not reachable by conventional piercing mechanisms or pins in prior art compressed CO2 driven devices (e.g., airguns). In one embodiment, the central opening 117 in the sidewall has a diameter equal to the diameter of the hole 115 through the shoulder 107 and the membrane 111. In one embodiment, the membrane 111 is longitudinally thinner than the shoulder 107 is and than the sidewall 109 is radially. That is, the membrane 111 is the thinnest portion of the pressure vessel 100.

A piercing mechanism for the pressure vessel 100 includes a pin 301, a housing 303, and a pressure vessel seal 305. The pin 301 is configured to pierce the membrane 111 of the pressure vessel 100. That is, the pin 301 has a diameter slightly smaller than the diameter of the central opening 117 in the sidewall 109 and is elongated to reach down from the shoulder 109 of the cap 103 to (and through) the membrane 111 when the pressure vessel 100 is received in the piercing mechanism (i.e., put in a compressed air driven device incorporating the piercing mechanism). The pin 301 includes an upper portion 307 at top of the pin 301, a lower portion 309 at a bottom of the pin 301, and a longitudinal passage 311 extension longitudinally through the pin 301.

The housing 303 is configured to receive the pin 301 and the neck 121 of the pressure vessel 100. In one embodiment, the housing 303 has threads 313 complementing the threads 123 on the neck 121 of the pressure vessel 100. The housing 303 is configured to align the pin 301 with the central opening 117 of the pressure vessel 100 and control longitudinal movement of the pressure vessel 100 when the pressure vessel 100 is received in the housing 303 (e.g., when the pressure vessel 100 is screwed into the housing 303). In other words, the threads 123, 313 cooperate to move the pressure vessel 100 longitudinally relative to the housing 303 as the threads 123, 313 are screwed together or apart.

The pressure vessel seal 305 is configured to seal between the neck 121 of the pressure vessel 100 and the housing 303 when the neck 121 of the pressure vessel 100 is received in the housing 303.

The lower portion 309 of the pin 301 has a width smaller than the width of the membrane 111 of the pressure vessel 100 and extends longitudinally farther than the membrane 111 is recessed from the surface of the pressure vessel 100. That is, the lower portion 309 of the pin 301 is configured to extend down into the 103 and pierce the membrane 111 when the pressure vessel 100 is seated in the housing 303. In one embodiment, the lower portion 309 of the pin 301 narrows to a point distal from the upper portion 307 of the pin 301 with the longitudinal passage 311 extending through the point (e.g., the point of the lower portion 309 of the pin 301 is conical or needlelike).

In one embodiment, the housing 303 is configured to receive pressurized gas from the pressure vessel 100 via the pin 301 when the pin 301 pierces the pressure vessel 100. The housing 303 further includes a conduit 319 configured to receive the pressurized gas from the pressure vessel 100 via the longitudinal passage 311 and the cavity 117 when the pin 301 pierces the pressure vessel 100. The conduit 319 is how a device utilizing the pressurized gas from the pressure vessel 100 receives the pressurized gas from the housing 303 of the piercing mechanism.

Figure 5:
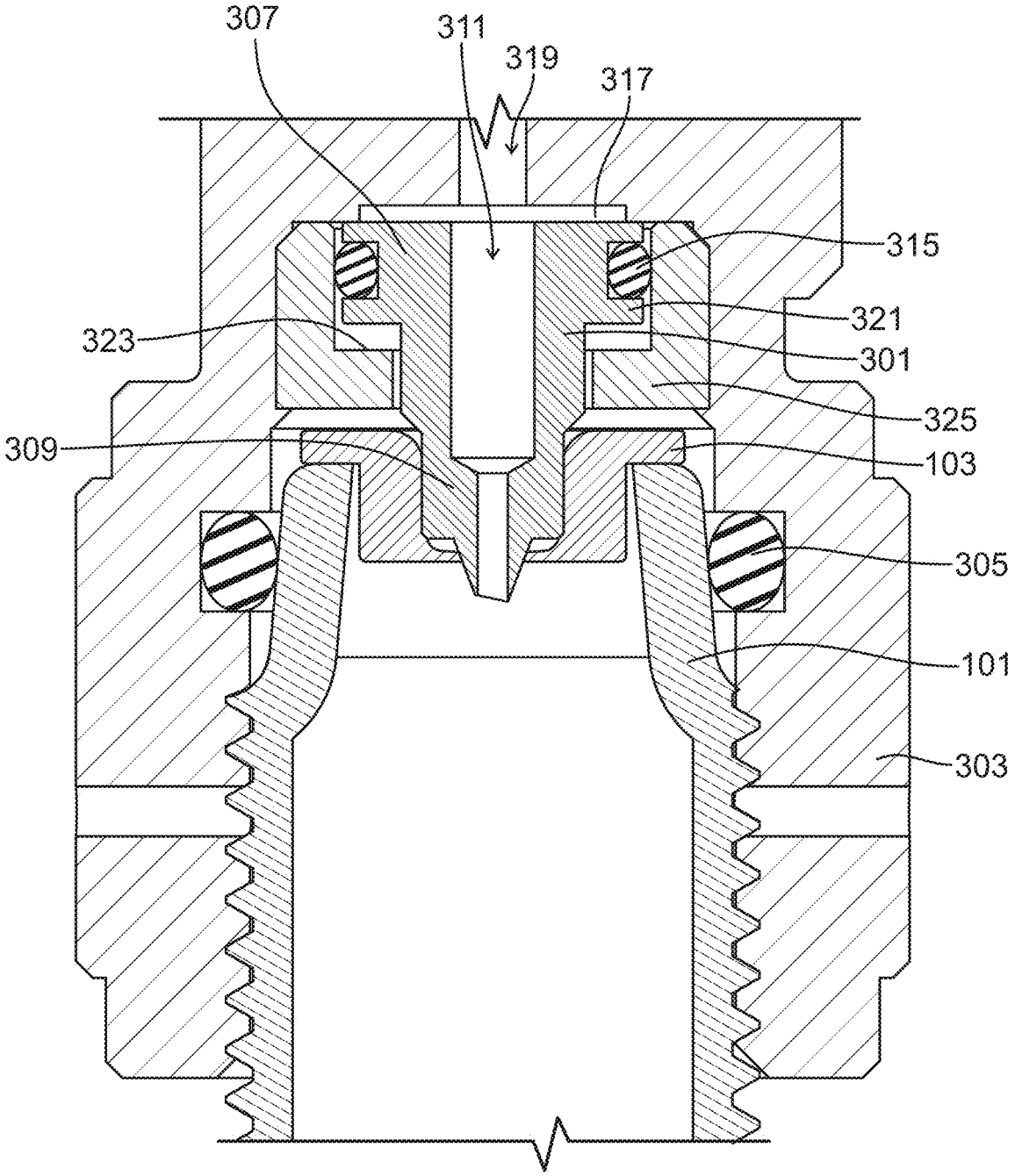
FIG. 5 is a side cutaway view of the neck of the pressure vessel of FIG. 1 inserted into a piercing mechanism with a movable pin according to another embodiment of the invention.

Referring particularly to FIG. 5, in one embodiment, the piercing mechanism further includes an upper pin seal 315 configured to seal between the upper portion 307 of the pin 301 and the housing 303. The upper portion 307 of the pin 301 has a larger diameter than the lower portion 309 of the pin 301. The pin 301 is movable longitudinally relative to the housing 303 such that when the lower portion 309 of the pin 301 pierces the membrane 111 of the pressure vessel 100, pressurized gas from the pressure vessel 100 travels through the longitudinal passage 311 28 cavity 317 between the top of the pin 301 and the housing 303 such that the pressurized gas pushes the pin 301 further into the pressure vessel 100. The longitudinal passage 311 extends down through the lower portion 309 of the pin 301 and up through the upper portion 307 of the pin 301 to fluidly connect an interior of the pressure vessel 100 to the cavity 317 between the top of the pin 301 and the housing 303 when the pressure vessel 100 is received in the housing 303. In one embodiment, the pressurized gas entering the cavity 317 between the top of the pin 301 and the housing 303 pushes the pin 301 longitudinally down relative to the housing 303 and pressure vessel 100.

Figure 6:
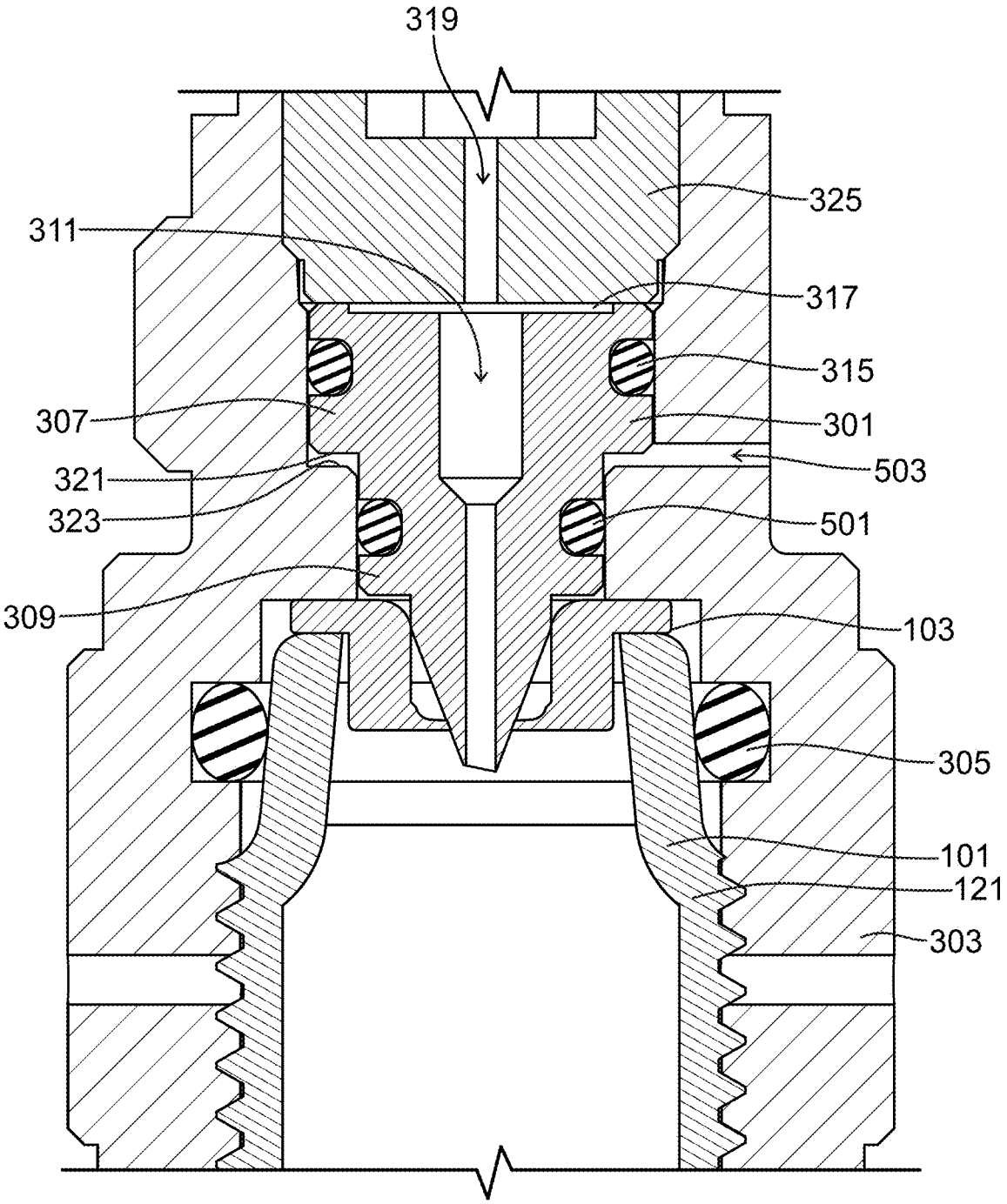
FIG. 6 is a side cutaway view of the neck of the pressure vessel of FIG. 1 inserted into a piercing mechanism with a movable pin and an atmospheric vent according to another embodiment of the invention.

Referring particularly to FIG. 6, in one embodiment, the piercing mechanism further includes a lower pin seal 501, and an atmospheric vent 503. The lower pin seal 501 is configured to seal between the pin 301 and the housing 303. The atmospheric vent 503 is through the housing between the upper pin seal 315 and the lower pin seal 501. The lower pin seal 501 and atmospheric vent 503 cooperate to prevent back pressure between the upper pin seal 315 and pressure vessel seal 305 which can limit downward travel of the pin 301 as pressure builds in the cavity 317. Back pressure between the upper pin seal 315 and pressure vessel seal 305 can also make it difficult to fully seat or screw in the pressure vessel 100 to the housing 303. In one embodiment, the lower pin seal 501 is configured to seal between the lower portion 309 of the pin 301 and the housing 303, and the lower pin seal 501 is below a stop 321 of the pin 301.

In one embodiment, the pin 301 includes stop 321. Stop 321 is a radial protrusion from the longitudinal passage 311. In one embodiment, the stop 321 is formed between the lower portion of the pin 309 and the upper portion of the pin 307. The housing 303 includes a seat 323 configured to contact the stop 321 such that the seat 323 and stop 321 cooperate to limit longitudinal movement of the pin 301 relative to the housing 303. In another embodiment, the housing 303 further includes a retainer 325 configured to limit longitudinal travel of the pin 301 to retain the pin 301 within the housing 303. In the embodiment of FIG. 5, the seat 323 is formed on the retainer 325 such that the retainer 325 limits downward travel of the pin 301. In the embodiment of FIG. 6, the retainer 325 limits upward movement of the pin 301 and the seat is built into a different portion of the housing 303. The retainer 325 may be interference fit, screwed in, or welded into the rest of the housing 303. In some embodiments, the components of the piercing mechanisms disclosed herein are generally steel except for the seals which may be rubber, silicone, neoprene, or any other suitable material. The seals are generally o-rings but any other suitable shapes may be utilized such as double lip.

Figure 7:
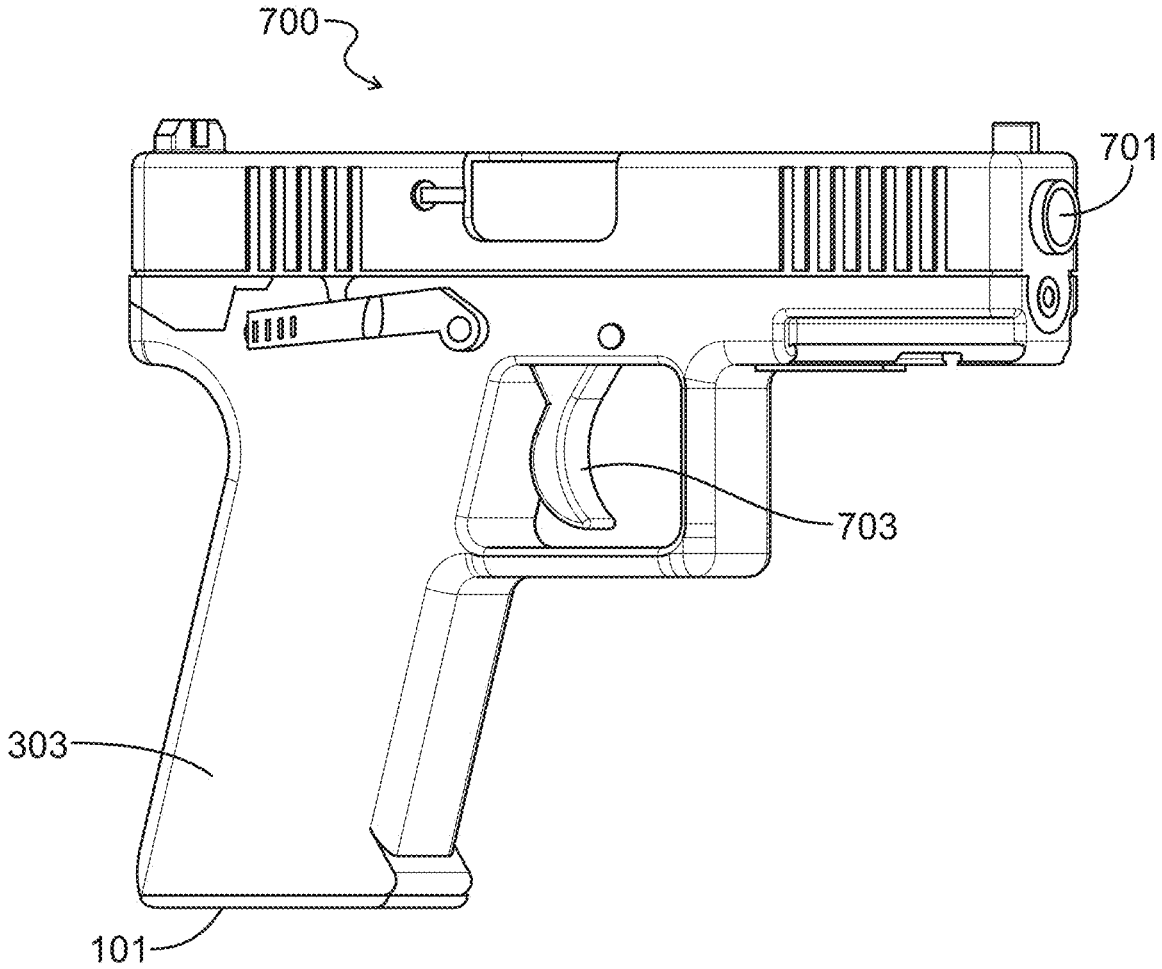
FIG. 7 is a side view of an airgun including the piercing mechanism of FIG. 6 and the pressure vessel of FIG. 1.

Referring particularly to FIG. 7, in one embodiment, an airgun 700 incorporates the piercing mechanism of FIG. 6. The airgun also includes a barrel 701, a trigger 703, and the pressure vessel 100. The barrel 701 is configured to launch a projectile from the barrel 701 when receiving pressurized gas. The trigger 703 is configured to selective release pressurized gas from the conduit 319 of the housing 303 to the barrel 701 such that the projectile is launched from the barrel 701.

Figure 8:
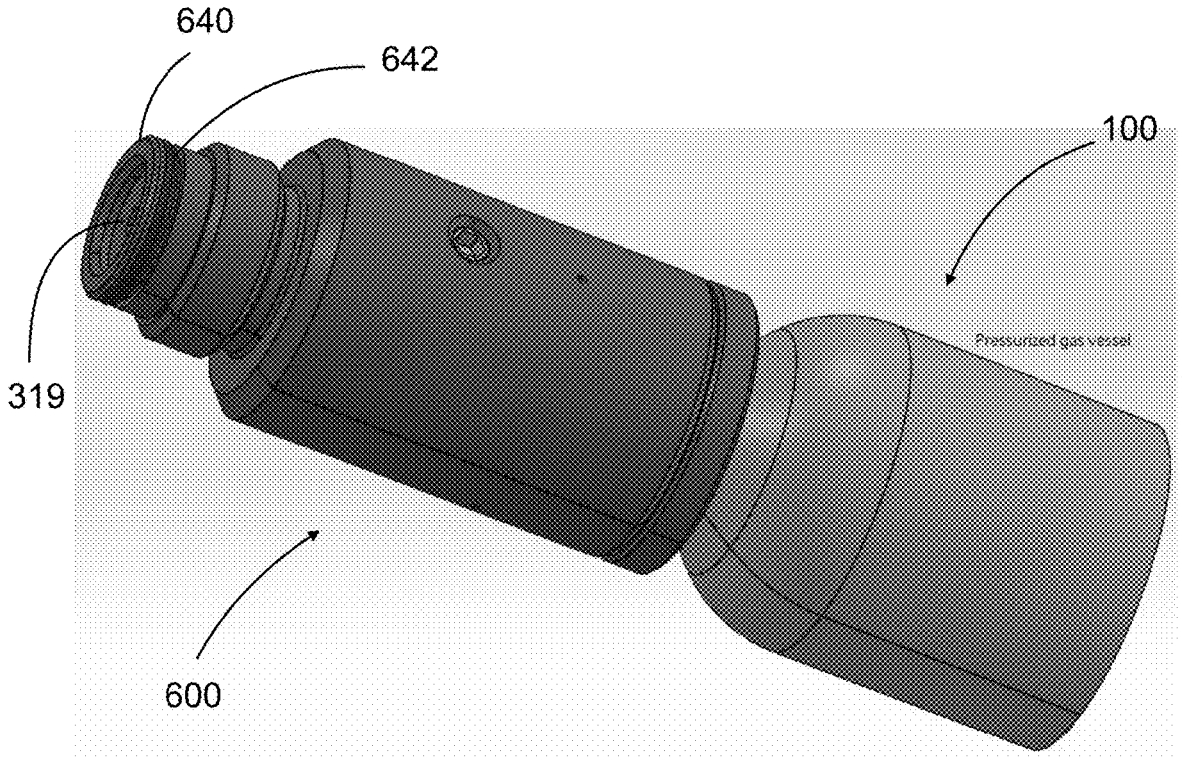
FIG. 8 is perspective view of the neck of the pressure vessel of FIG. 1 received in a spring-loaded piercing mechanism with a movable pin and an atmospheric vent according to another embodiment of the invention.

Turning now to FIG. 8, there is shown an embodiment of a spring-loaded piercing mechanism 600 formed in accordance with another aspect of the invention. A pressure vessel 100 is connected to the piercing mechanism 600 in the manner previously described. That is, the threaded neck 101 of the hollow body 101 is received in an aperture of the piercing mechanism 600 and coupled thereto via complimentary threads 313 in the piercing mechanism 600. Pressurized gas supplied from the pressure vessel 100 through the piercing mechanism 600 exits the piercing mechanism 600 through a conduit 319 defined in an outlet 640 at an end of the piercing mechanism 600 opposite the pressure vessel 100. The outlet 640 is fitted with an outlet seal 642 that seals a connection between the piercing mechanism 600 and a device utilizing the pressurized gas from the pressure vessel, such as an airgun 700. To be clear, in some embodiments, the airgun of FIG. 7 can incorporate the spring-loaded piercing mechanism 600 of FIG. 9 or 10 instead of the piercing mechanism of FIG. 6.

Figure 9:
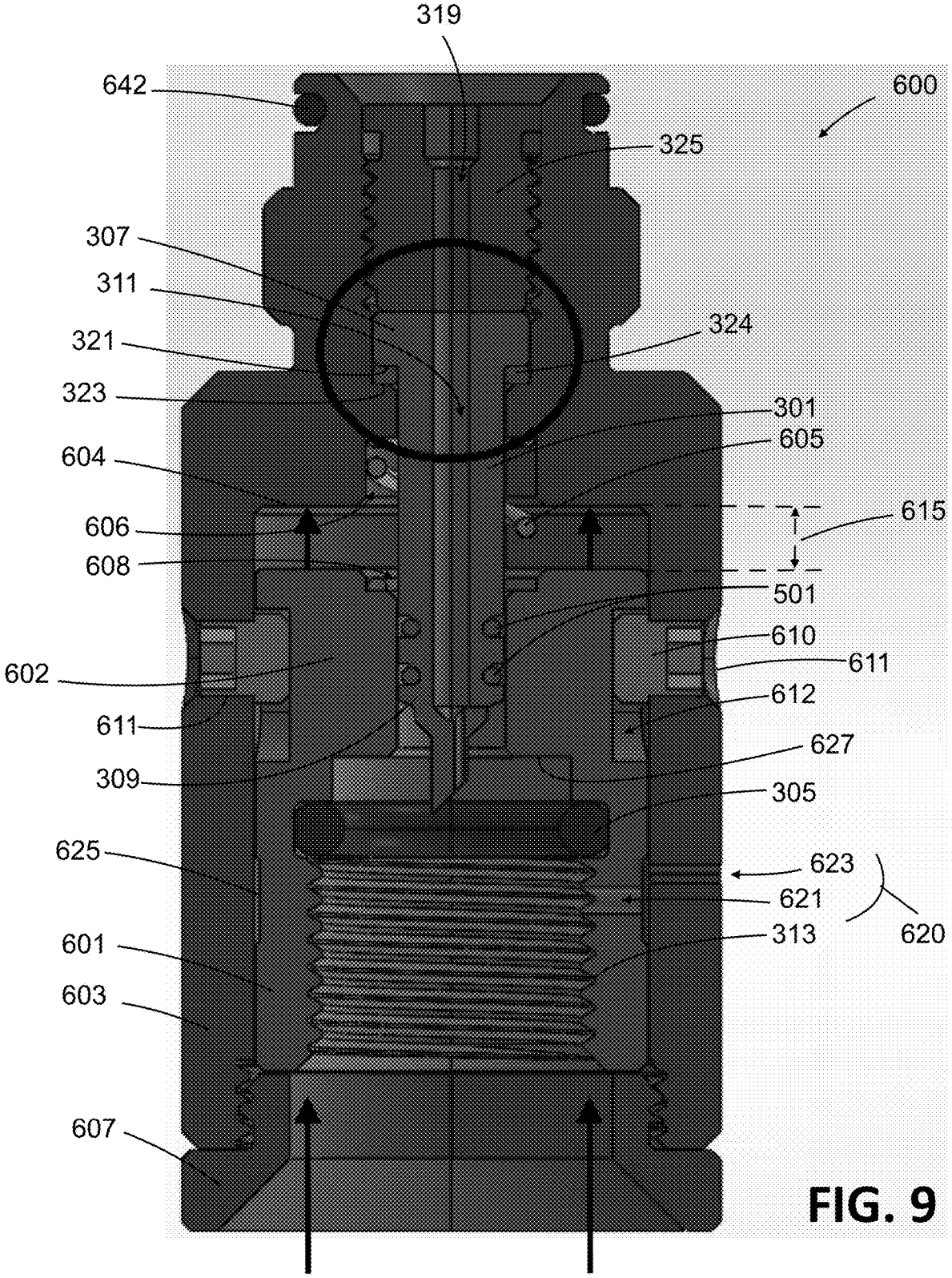
FIG. 9 is a side cutaway view of the spring-loaded piercing mechanism with movable pin and atmospheric vent of FIG. 8. The pressure vessel is omitted for clarity.

Referring now to FIG. 9, the piercing mechanism 600 includes an inner housing 601, an outer housing 603 (or shell) in which the inner housing 601 is slidably received, a pin 301 in the outer housing 603, a pin retainer 325 in the outer housing 603, and a biasing member 605.

The inner housing 601 is configured to receive the neck 121 of the pressure vessel 101. The inner housing 601 includes threads 313 that are complimentary to the threads 123 on the neck 121 of the pressure vessel 100. The pressure vessel 100 is received in the inner housing 601 when the neck 121 is fully inserted into the inner housing 601 with the threads 123 of the inner housing 601 engaging the threads 313 on the pressure vessel neck 121 and the upper surface 122 of the pressure vessel 100 engaging a pressure vessel stop 627 in the inner housing 601. Rotation of the pressure vessel 100 in the inner housing 601 causes threads 123 to slide against threads 313 and thereby move the pressure vessel 100 longitudinally into or out of the inner housing 601, depending on the direction of vessel rotation. In this way, the inner housing 601 is configured to control longitudinal movement of the pressure vessel 100 in the inner housing 601. A pressure vessel seal 305 is seated in an internal annular groove of the inner housing 601. The pressure vessel seal 305 is configured to seal between the neck 121 of the pressure vessel 100 and the inner housing 601 when the neck 121 of the pressure vessel 100 is received in the inner housing 601.

The outer housing 603 defines an interior space in which the inner housing 601 is received. The inner housing 601 is slidable in the interior space of the outer housing 603. The interior space is configured to closely receive the inner housing 601. However, the interior space is longitudinally longer than the inner housing 601 so that the inner housing 601 can slide longitudinally up and down in the interior space. The outer housing 603 is configured to constrain the inner housing 601 to reciprocating longitudinal movement in the outer housing 603. The outer housing 603 includes two removable guide studs 610 on the outer housing 603. The guide studs 610 are received in apertures 611 defined through the outer housing 603. In some embodiments, the outer housing 603 can include more than two guide studs 601 received in a corresponding number of apertures 611. The apertures 611 and guide studs 610 are disposed on opposite sides of the outer housing 603. The guide studs 610 extend from the outer housing 603, toward the interior space, and into respective longitudinally elongated guide tracks 612 defined in an exterior surface of the inner housing 601. The guide tracks 612 have a width approximately the same as the diameter of the guide studs 610. This deters rotation of the inner housing 601 relative to the outer housing 603. The guide tracks have a longitudinal length approximately equal to the diameter of the guide studs 610 plus a distance 615 by which the biasing member 605 spaces the inner housing 601 from the interior surface 604 of the outer housing 603 (explained in more detail below). This prevents the inner housing 601 from inadvertently falling out of or exiting the bottom end of the outer housing 603. Consequently, the guide studs 610 received in the guide tracks 612 advantageously retain the inner housing 601 in the outer housing 603 and prevent the inner housing 601 from rotating inside the outer housing 603. This in turn enables a user to manually screw the threaded neck 121 of the pressure vessel 100 into and out of the inner housing 601 by anchoring the inner housing 601 to the outer housing 603.

The pin 301 is received in the outer housing 603. More specifically, an upper portion 307 of the pin 301 at a top of the pin 301 is received in the outer housing 603. The pin 301 extends longitudinally through a portion of the outer housing 603. The pin 301 is substantially fixed in position relative to the outer housing 603. A lower portion 309 of the pin 301 at bottom of the pin 301 extends longitudinally through a portion 602 of the inner housing 601, such as wall 602. The lower portion 309 of the pin 301 defines two annular grooves in which two lower pin seals 501 are respectively received. In other embodiments, the lower portion 309 of the pin can define only one annular groove or more than two annular grooves in which a corresponding number of lower pin seals 501 are received. The lower pin seals 501 are configured to seal between the lower portion 309 of the pin 301 and the portion 602 of the inner housing 601 through which the pin 301 extends (i.e., wall 602). The inner housing 601 and outer housing 603 are configured to align the pin 301 with the cylindrical central opening 117, and thus the membrane 111, of the pressure vessel 100 when the pressure vessel 100 is received in the inner housing 601. As such, the pin 301 extends longitudinally through the outer housing 603 and a portion of the inner housing 601 in alignment with the membrane 111.

The upper portion 307 of the pin 301 has a larger diameter than the lower portion 309 of the pin 301. The pin 301 includes a stop 321 in the form of a radial protrusion. The outer housing 603 includes a seat 323 configured to contact the stop 321 such that the seat 323 and the stop 321 cooperate to limit longitudinal movement of the pin 301 relative to the outer housing 603. That is, cooperation of the stop 321 and the seat 323 limits downward movement of the pin 301 relative to the outer housing 603. As explained in more detail below, the lower portion 309 of the pin 301 is configured to selectably pierce the membrane 111 when the pressure vessel 100 is received in the inner housing 601.

A pin retainer 325 is received in the outer housing 603. The pin retainer 325 is configured to retain the pin 301 within the outer housing 603. The pin retainer 325 is threadingly engaged with the outer housing 603 above of the pin 301. In some embodiments, the pin retainer 325 is threadingly engaged with the outer housing 603 on top of the pin 301. The pin retainer 325 can fix the pin 301 in place relative to the outer housing 603 by holding the stop 321 against the seat 323 or a gasket 324 on the seat 323. The pin retainer 325 limits longitudinal travel (i.e., upward movement) of the pin 301 in the outer housing 603 and thereby prevents the pin 301 from exiting the outer housing 603. The pin retainer 325 defines a conduit 319 configured to receive the pressurized gas from the pressure vessel 100 via the longitudinal passage 307 extending longitudinally through the pin 301 (and in some embodiments, the cavity 117) when the pin 301 pierces the pressure vessel 100. The conduit 319 is how a device utilizing the pressurized gas from the pressure vessel 100 receives the pressurized gas from the piercing mechanism 600.

Figure 10:
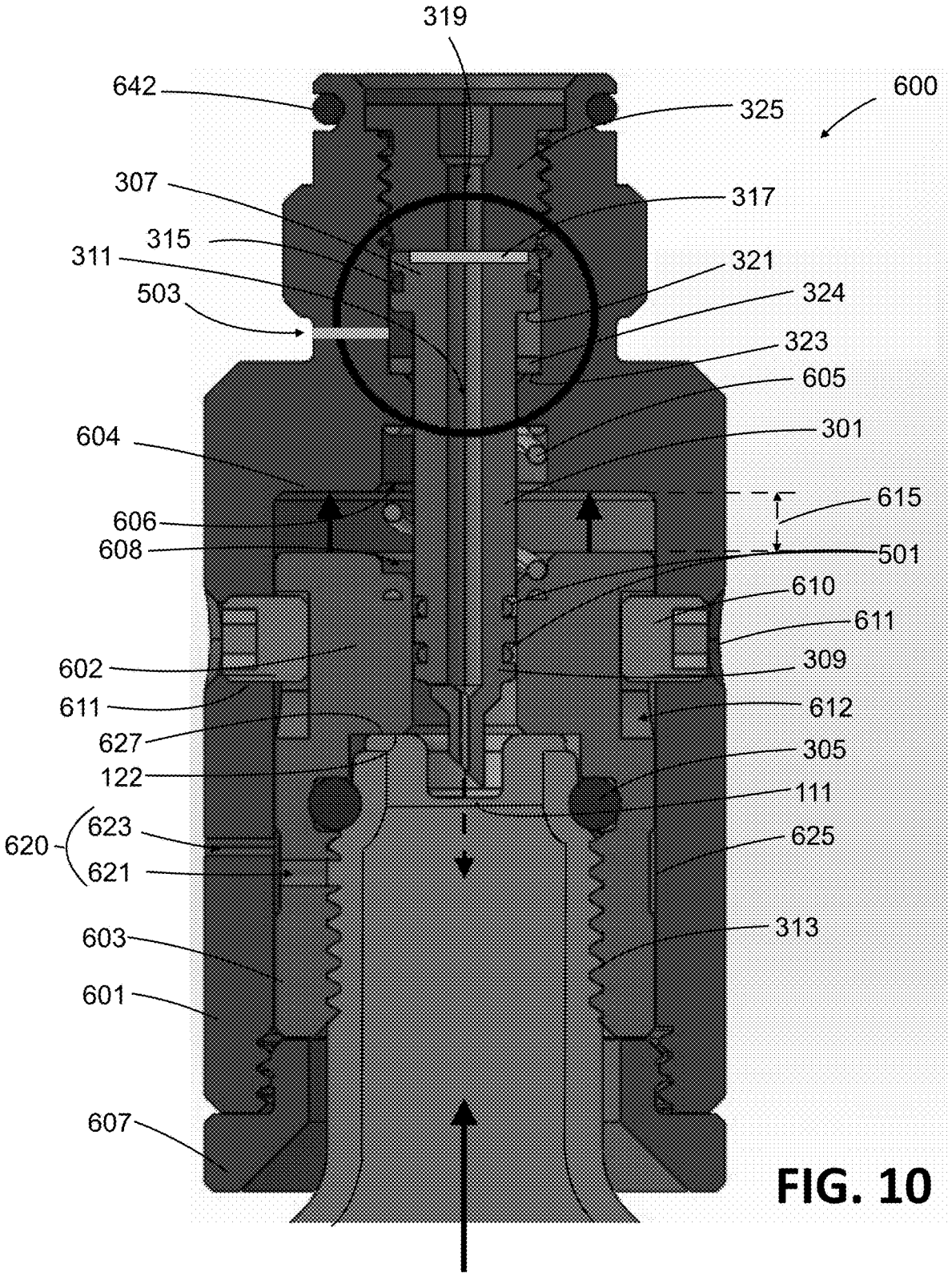
FIG. 10 is a side cutaway view of the neck of the pressure vessel of FIG. 1 inserted into a spring-loaded piercing mechanism with a movable pin and an atmospheric vent according to yet another embodiment of the invention.

The biasing member 605 is received in the outer housing 603 and arranged to push the inner housing 601 longitudinally away from an interior surface 604 of the outer housing 603 (i.e., downward) so that the pin 301 does not contact the membrane 111 when the pressure vessel 100 is received in the inner housing 601 (as more clearly illustrated in FIG. 10). Put another way, the biasing member 605 biases the inner housing 601 toward a resting position (as shown in both FIGS. 9 and 10) wherein the portion 602 of the inner housing 601 through which the pin 301 extends (i.e., wall 602) is spaced from the interior surface 604 of the outer housing 603 so that the pin 301 does not contact the membrane 111 when the pressure vessel 100 is received in the inner housing 601. The biasing member 605 is configured to space the inner housing 601 a distance 615 from the interior surface 604 of the outer housing 603. Specifically, the upper end of the biasing member 605 is seated in a recess 606 of the outer housing 603 around the pin 301 while the lower end of the biasing member 605 is seated in a recess 608 of the inner housing 601 around the lower portion 309 of the pin 301. The recesses 606, 608 capture respective upper and lower ends of the biasing member 605. In one embodiment, the biasing member 605 is a compression spring 605. In other embodiments (not shown), the biasing member can be any other suitable type or spring or wire form.

The inner housing 601 is selectably slidable toward the interior surface 604 of the outer housing 603 to compress the biasing member 605 and cause the lower portion 309 of the pin 301 to pierce the membrane 111 upon the application of a force (manual or otherwise) to a tail end 120 of the pressure vessel 100 when the pressure vessel 100 is received in the inner housing 601. The direction of the force is indicated by solid arrows. The tail end 120 of the pressure vessel 100 is opposite the membrane 111. The inner housing 601 is in a working position (not shown) when the biasing member 605 is sufficiently compressed by the inner housing 601 against the interior surface 604 of the outer housing 603 that the lower portion 309 of the pin 301 can pierce the membrane 111 of the pressure vessel 100 while the pressure vessel 100 is received in the inner housing 601. In this way, the biasing member 605 is selectably compressible to cause the pin 301 to pierce the membrane 111. In order to ensure the pin 301 can pierce the membrane 111, the pin 301 is sized to extend longitudinally further than the membrane 11 is recessed from the upper surface 122 of the pressure vessel 100 when the biasing member 605 is compressed against the interior surface 604 of the outer housing 603 by the inner housing 601 and the pressure vessel 100 is received in the inner housing 601.

In some embodiments, including those depicted in FIGS. 9 and 10, the piercing mechanism 600 further includes a housing retainer 607. The housing retainer 607 is received in a bottom end of the outer housing 603. The housing retainer 607 is configured to retain the inner housing 601 within the outer housing 603 by limiting longitudinal travel of the inner housing 601 in the outer housing 603. Put another way, the housing retainer 607 prevents the inner housing 601 from exiting the outer housing 603. The housing retainer 607 includes threads complimentary to threads on the bottom end of the outer housing 603. The housing retainer 607 is an annular member defining a central hole through which the neck 121 of the pressure vessel 100 is receivable into the inner housing 601. In this way, the housing retainer 607 is configured to allow the pressure vessel neck 121 to extend through the housing retainer 607. In other embodiments, the housing retainer 607 can be configured to releasably engage the bottom end of the outer housing 603 via a snap fit or other suitable connection mechanism. In some embodiments, the housing retainer 607 can have a non-annular shape. In some embodiments not shown, the housing retainer 607 can be omitted. However, the housing retainer 607 advantageously provides a positive stop against which the entire circumferential periphery of the inner housing 601 can abut to ensure that the inner housing 601 remains in the outer housing 603 during use. The housing retainer 607 thus provides a stronger and more reliable stop for the inner housing 601 than the thinner guide studs 610 received in the guide tracks 612, which in the depicted embodiment only provide two points of contact.

In some embodiments, including those depicted in FIGS. 9 and 10, the piercing mechanism 600 further includes a safety vent system 620. The safety vent system 620 extends through the inner and outer housing 601, 603 below the pressure vessel seal 305. Specifically, an inner vent 621 extends through the inner housing 601 below the pressure vessel seal 305. At least one outer vent 623 extends through the outer housing 603. The outer vent 623 is below the pressure vessel seal 305. In some embodiments, the outer vent 623 can be a plurality of outer vents spaced around the circumference of the outer housing 603. The outer vent(s) 623 can have a combined inner diameter surface area larger than an inner diameter surface area of the inner vent 621. A recess 625 is defined in the exterior surface of the inner housing 601. The recess 625 is annular and extends around the exterior surface of the inner housing 601. The recess 625 is in fluid communication with the inner vent 621 and the outer vent(s) 623. The inner vent 621 is thus in fluid communication with the outer vent(s) 623 through the recess 625. The safety vent system 620 prevents the pressure vessel 100 from energetically exiting (i.e., shooting out of) the inner housing 601 and laterally moving the pressure vessel 100 and spring loaded piercing mechanism 600 in the event that the pressure vessel 100 becomes unseated from the threads 313 and disengaged from the pressure vessel seal 305 via tampering, accident, or otherwise. By the time the pressure vessel threads 123 become fully unthreaded from inner housing threads 313, all pressurize gas in the pressure vessel 100 will be vented through the safety vent system 620 as described above. The use of three or more outer vents 623 spaced around the circumference of the outer housing 603 distributes the pressure of venting gas around the inner housing 601 and thereby prevents the venting gas from energetically and unexpectedly pushing the pressure vessel 100, housings 601, 603, and the stock of an airgun (not shown) or other device in which the spring loaded piercing mechanism 600 may be contained laterally out of a user's hands and into the user's face or other soft region.

Referring particularly to FIG. 10, there is depicted a piercing mechanism 600 alike in all aspects of form and function to the piercing mechanism 600 depicted in FIG. 9 except as specifically disclosed to the contrary herein. The piercing mechanism 600 of FIG. 10 includes a movable pin 301 similar to that of FIG. 6. Specifically, the piercing mechanism 600 depicted in FIG. 10 includes an upper pin seal 315 configured to seal between the upper portion 307 of the pin 301 and the outer housing 603. The pin 301 is longitudinally movable relative to the outer housing 603 such that when the lower portion 309 of the pin 301 pierces the membrane 111 of the pressure vessel 100, pressurized gas from the pressure vessel 100 travels through the longitudinal passage 311 to a cavity 317 at or between the top of the pin 301 and the pin retainer 325 such that the pressurized gas pushes the pin 301 further into the pressure vessel 100. The cavity 317 can be a recess defined in one or both of the uppermost surface of the pin 301 and the lower surface of the retainer 325. This allows pressurized gas to immediately enter the cavity 317 and act on the pin 301. The pressurized gas entering the cavity 317 at or between the top of the pin 301 and the pin retainer 325 pushes the pin 301 longitudinally down relative to the outer housing 603 and the pressure vessel 100, as indicated by a dashed arrow. The movable pin 301 ensures that complete piercing is accomplished swiftly and cleanly, even when the force applied to the tail end 120 of the pressure vessel 100 is insufficient to cause the lower portion 309 of the pin 301 to fully penetrate the membrane 111.

The spring-loaded piercing mechanisms 600 disclosed herein make it quicker and easier for a user to supply pressurized gas to a pressurized gas-operated device, such as an airgun, by reducing the strength required to cleanly pierce a pressure vessel 100. Specifically, whereas the piercing mechanisms of FIGS. 4-6 require a user to manually screw the pressure vessel 100 into a housing 303 until the pin 301 pierces the pressure vessel membrane 111, the piercing mechanisms 600 of FIGS. 8-10 require only that the user manually screw the pressure vessel 100 into the inner housing 601 until the pressure vessel upper surface 122 is seated against the pressure vessel stop 627. The user may then (immediately or later) apply a force to the tail end 120 of the pressure vessel 100 by slamming the tail end 120 against a nearby surface such as a tabletop, wall, or palm. This both reduces the manual rotational effort necessary to pierce the pressure vessel 100 and enables a user to preload a pressure vessel 100 into the piercing mechanism 600 for piercing at a later time.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A piercing mechanism for a pressure vessel having a recessed membrane, said piercing mechanism comprising:

an inner housing configured to receive the pressure vessel and control longitudinal movement of the pressure vessel in the inner housing;

an outer housing in which the inner housing is slidably received;

a pin in the outer housing extending longitudinally through a portion of the inner housing in alignment with the membrane and configured to selectably pierce the membrane when the pressure vessel is received in the inner housing; and a biasing member in the outer housing configured to bias the inner housing longitudinally away from an interior surface of the outer housing so that the pin does not contact the membrane when the pressure vessel is received in the inner housing;

wherein the inner housing is selectably slidable to compress the biasing member and cause the pin to pierce the membrane when the pressure vessel is received in the inner housing.

2. The piercing mechanism of claim 1, wherein the inner housing is constrained to reciprocating longitudinal movement in the outer housing.

3. The piercing mechanism of claim 1, further comprising:

at least one guide track defined in the inner housing; and at least one guide stud on the outer housing extending into the at least one guide track.

4. The piercing mechanism of claim 1, wherein the pin extends longitudinally further than the membrane is recessed from a surface of the pressure vessel when the biasing member is compressed against the outer housing by the inner housing and the pressure vessel is received in the inner housing.

5. The piercing mechanism of claim 1, further comprising a housing retainer configured to limit longitudinal travel of the inner housing, retain the inner housing within the outer housing, and receive a neck of the pressure vessel through the housing retainer.

6. The piercing mechanism of claim 1, further comprising:

a longitudinal passage extending longitudinally through the pin;

a pressure vessel seal in the inner housing configured to seal between the pressure vessel and the inner housing when the pressure vessel is received in the inner housing; and at least one lower pin seal on the pin configured to seal between the pin and the portion of the inner housing through which the pin extends.

7. The piercing mechanism of claim 6, further comprising:

an inner vent through the inner housing below the pressure vessel seal;

a recess defined around the exterior surface of the inner housing in fluid communication with the inner vent; and at least one outer vent through the outer housing in fluid communication with the recess.

8. The piercing mechanism of claim 1, further comprising:

a pin retainer configured to retain the pin within the outer housing and receive pressurized gas from the pressure vessel via the pin when the pin pierces the pressure vessel.

9. The piercing mechanism of claim 8, wherein the pin retainer comprises a conduit configured to receive the pressurized gas from the pressure vessel via a longitudinal passage extending longitudinally through the pin when the pin pierces the pressure vessel.

10. The piercing mechanism of claim 1, wherein the inner and outer housing are configured to align the pin with the membrane of the pressure vessel.

11. The piercing mechanism of claim 1, wherein:

the pin comprises an upper portion at a top of the pin and a lower portion at a bottom of the pin;

the upper portion of the pin is received in the outer housing;

the lower portion of the pin is received in the inner housing and is configured to pierce the membrane; and the upper portion of the pin has a larger diameter than the lower portion of the pin.

12. The piercing mechanism of claim 11, further comprising:

a pin retainer configured to retain the pin within the outer housing; and an upper pin seal configured to seal between the upper portion of the pin and the outer housing;

wherein the pin is longitudinally movable relative to the outer housing such that when the lower portion of the pin pierces the membrane of the pressure vessel, pressurized gas from the pressure vessel travels through the longitudinal passage to a cavity at or between the top of the pin and the pin retainer such that the pressurized gas pushes the pin further into the pressure vessel.

13. The piercing mechanism of claim 12, wherein the pressurized gas entering the cavity pushes the pin longitudinally down relative to the outer housing and the pressure vessel.

14. The piercing mechanism of claim 1, wherein:

the pin comprises a stop in the form of a radial protrusion; and the outer housing comprises a seat configured to contact the stop such that the seat and the stop cooperate to limit longitudinal movement of the pin relative to the outer housing.

15. An airgun comprising the piercing mechanism of claim 1.

16. A piercing mechanism for a pressure vessel having a recessed membrane, said piercing mechanism comprising:

an inner housing configured to receive the pressure vessel and control longitudinal movement of the pressure vessel in the inner housing;

an outer housing in which the inner housing is slidably receivable, the outer housing configured to constrain the inner housing to reciprocating longitudinal movement in the outer housing;

a pin receivable in the outer housing and configured to extend longitudinally through a portion of the inner housing in alignment with the membrane and selectably pierce the membrane when the inner housing is received in the outer housing and the pressure vessel is received in the inner housing; and a biasing member receivable in the outer housing and configured to bias the inner housing longitudinally away from an interior surface of the outer housing so that the pin does not contact the membrane when the pressure vessel is received in the inner housing;

wherein the biasing member is selectably compressible to cause the pin to pierce the membrane upon the application of a force to a tail end of the pressure vessel when inner housing and biasing member are received in the outer housing and the pressure vessel is received in the inner housing.

17. An airgun comprising the piercing mechanism of claim 16.

18. A piercing mechanism for a pressure vessel having a membrane recessed from a surface of the pressure vessel within a generally cylindrical central opening of the pressure vessel, said piercing mechanism comprising:

a pin configured to pierce the membrane, the pin including an upper portion at a top of the pin, a lower portion at a bottom of the pin having a width smaller than a width of the membrane, and a longitudinal passage extending longitudinally through the pin;

an inner housing configured to receive the lower portion of the pin and a neck of the pressure vessel, align the lower portion of the pin with the central opening of the pressure vessel, and control longitudinal movement of the pressure vessel in the inner housing when the neck of the pressure vessel is received in the inner housing;

a pressure vessel seal in the inner housing configured to seal between the neck of the pressure vessel and the inner housing when the neck of the pressure vessel is received in the inner housing;

at least one pin seal on the lower portion of the pin configured to seal between the pin and the inner housing;

an outer housing configured to receive the upper portion of the pin and the inner housing, align the upper portion of the pin with the central opening of the pressure vessel, and constrain the inner housing to reciprocating longitudinal movement in the outer housing when the inner housing is received in the outer housing and the neck of the pressure vessel is received in the inner housing; and a biasing member in the outer housing configured to bias the inner housing longitudinally away from an interior surface of the outer housing and thereby space the membrane from the lower portion of the pin when the inner housing is received in the outer housing and the neck of the pressure vessel is received in the inner housing;

wherein the inner housing is selectably slidable in the outer housing to compress the biasing member and thereby cause the pin to pierce the membrane upon the application of a force to an end of the pressure vessel opposite the membrane when the inner housing is received in the outer housing and the neck of the pressure vessel is received in the inner housing.

19. The piercing mechanism of claim 18, wherein the lower portion of the pin extends longitudinally further than the membrane is recessed from the surface of the pressure vessel when the biasing member is compressed by the inner housing against the outer housing and the neck of the pressure vessel is received in the inner housing.

20. An airgun comprising the piercing mechanism of claim 18.

* * * * *